US010682036B2

(12) United States Patent
Sacks

(10) Patent No.: US 10,682,036 B2
(45) Date of Patent: Jun. 16, 2020

(54) CLEANING DEVICE

(71) Applicant: AVET AG, Rueti/Zurich (CH)

(72) Inventor: Roland Sacks, Steinhausen (CH)

(73) Assignee: AVET AG, Rueti/Zurich (CH)

( * ) Notice: Subject to any disclaimer, the term of this patent is extended or adjusted under 35 U.S.C. 154(b) by 56 days.

(21) Appl. No.: 15/748,358

(22) PCT Filed: Jul. 25, 2016

(86) PCT No.: PCT/EP2016/001288
§ 371 (c)(1),
(2) Date: Jan. 29, 2018

(87) PCT Pub. No.: WO2017/016658
PCT Pub. Date: Feb. 2, 2017

(65) Prior Publication Data

US 2018/0213996 A1 Aug. 2, 2018

(30) Foreign Application Priority Data

Jul. 29, 2015 (DE) ..... 10 2015 009 751

(51) Int. Cl.
*A47L 13/22* (2006.01)

(52) U.S. Cl.
CPC ..... *A47L 13/22* (2013.01)

(58) Field of Classification Search
CPC ..... A47L 13/22
See application file for complete search history.

(56) References Cited

U.S. PATENT DOCUMENTS 6,497,525 B1 * 12/2002 Huang ..... A47L 13/22 401/137
7,722,273 B2 * 5/2010 Tanaka ..... A47L 13/22 401/136
7,850,384 B2 12/2010 Sacks
2004/0223803 A1 11/2004 Fahy et al.
2006/0204316 A1 * 9/2006 Sacks ..... A47L 13/22 401/139

(Continued)

FOREIGN PATENT DOCUMENTS

DE 10040014 3/2002
DE 202008012177 2/2008

(Continued)

*Primary Examiner* — J C Jacyna
(74) *Attorney, Agent, or Firm* — Volpe and Koenig, P.C.

(57) ABSTRACT

The invention relates to a cleaning device for spreading a cleaning or disinfection fluid over an area, including a storage container (2) for storing the cleaning or disinfection fluid, including a dispensing member (4) which (4) is interposed in an outlet line (3) connected to the storage container (2) and which can be actuated via a handle (5), as well as having a tubular shaft (6) on which the handle (5) can be moveably guided or retained, which handle (5) is connected in a controllable manner to the discharge member (4) via a connecting rod (7) provided inside the tubular shaft (6). According to the invention, the cleaning device is characterized in that, inter alia, the shaft (6) of the cleaning device (1) has at least two tubular shaft sections (8, 9; 9, 10) that can be connected to one another, and a respective associated rod section (11, 12) of the connecting rod (7) is provided inside said tubular shaft sections.

31 Claims, 5 Drawing Sheets

(56) References Cited

U.S. PATENT DOCUMENTS

| | | | | |
|---|---|---|---|---|
| 2012/0222227 | A1* | 9/2012 | Johnson | A47L 11/4002 15/105 |
| 2013/0263398 | A1* | 10/2013 | Irwin | A47L 13/22 15/228 |
| 2015/0272314 | A1* | 10/2015 | Vandenbroucke | A47L 13/22 401/268 |
| 2019/0014967 | A1* | 1/2019 | Ribbe | A46B 11/0013 |

FOREIGN PATENT DOCUMENTS

| | | |
|---|---|---|
| EP | 1180343 | 2/2002 |
| EP | 1688081 | 8/2006 |
| WO | 2006066634 | 6/2006 |

* cited by examiner

CLEANING DEVICE

BACKGROUND

The invention relates to a clearing device for spreading a cleaning or disinfecting liquid, having a storage container for storing the cleaning or disinfecting liquid, having a dispensing member which is interdisposed in an outlet line that is connected to the storage connector and is activatable by way of a handling element, and having a tubular shaft on which the handing element is guided or held in a movable manner, said handing element by way of a connecting rod that is provided in the interior of the tube of the shaft in terms of actuation being connected to the dispensing member.

A cleaning device of the type mentioned at the outset which is specified for spreading a cleaning or disinfecting liquid is already known from DE 100 40 014 A1. To this end, the previously known cleaning device has a distribution face which by way of a universal joint is connected to the floor-side shaft end of a shaft. A storage container which is specified for storing the cleaning or disinfecting liquid is releasably held on this shaft. A handling element which is configured as a push or activation button is displaceably guided in the shaft end of the shaft that faces away from the distribution face. A dispensing member which is interdisposed in an outlet line that is connected to the storage container is activatable by way of this handing element. An actuation movement on the handling element is thus converted to the opening movement of the dispensing member in such a manner that the desired quantity of the cleaning or disinfecting liquid that is stored in the storage container can flow out. However, since the dispensing member is disposed in the interior of the tube of the tubular shaft, since the handling element has to be activated counter to comparatively high restoring forces, and since the respective activation forces have to be applied exclusively on the handing element that is configured just as a push or activation button, the operation of the previously known cleaning device is strenuous and tiring. Since the previously known cleaning device first has to be shipped to the user and subsequently has to be transported by said user to each application site, the comparatively long shaft often gets in the way.

Comparable cleaning devices are also known from WO 2006/066634 A1, from EP 1 180 343 B2, and from EP 1 688 081 A2.

SUMMARY

There is therefore inter alia the object of providing a cleaning device of the type mentioned at the outset which in relation to the above can be shipped or transported, respectively, to the user and/or to the application sites in a significantly simpler manner.

The solution to this object according to the invention in the case of the cleaning device of the type mentioned of the outset lies in particular in that the shaft of the cleaning device has at least two inter-connectable tubular shaft portions, in each case one assigned shaft portion of the connecting rod being provided in the interior of the tubes of said shaft portions.

The cleaning device according to the invention is specified for spreading a cleaning or disinfecting liquid. To this end, said cleaning device according to the invention has a storage container in which the cleaning or disinfecting liquid is stored. This storage container is connected to an outlet line, a dispensing member being interdisposed in said outlet line. The dispensing member is manually activatable by way of a handling element which is guided or held in a movable manner on a tubular shaft. The handling element by way of a connecting rod that is provided in the interior of the tube of the shaft in terms of drive is connected to the dispensing member. The shaft of the cleaning device according to the invention herein has at least two inter-connectable tubular shaft portions, in each case one assigned rod portion of the connecting rod being provided in the interiors of the tubes of said shaft portions. Since the shaft of the cleaning device according to the invention has at least two tubular shaft portions which prior to transportation of the cleaning device according to the invention can also be packed separately from one another, and since these shaft portions in comparison to the shaft that is assembled therefrom have only a shortened length, the transportation of the cleaning device according to the invention is possible in a comparatively simple and space-saving manner.

In order for the cleaning device according to the invention to be able to be transported to each application site in a space-saving manner again and again, it is advantageous when of the at least two shaft portions at least two adjacent shaft portions are inter-connectable in a releasable and preferably releasably latchable manner. If these adjacent shaft portions are inter-connectable in a releasably latchable manner, said shaft portions can also be interconnected and released from one another without tools.

In order for the shaft that is formed from at least two shaft portions, despite the capability of disassembly, to nevertheless be designed as stable as possible, one preferred embodiment according to the invention provides that of the interconnectable adjacent shaft portions one shaft portion and preferably the shaft portion that supports the handling element or the shaft portion that faces the handling element, by way of an end region that is preferably reduced in the cross section is insertable or plug-fittable into the interior of the tube of the adjacent shaft portion. The inter-connectable shaft portions thus have only to be plug-fitted or push-fitted into one another in order for a stable and stressable shaft to nevertheless be obtained.

It is advantageous when the handling element, counter to a restoring force, is movable from a non-activated standby position to the activation position of said handling element, the dispensing member dispensing the cleaning or disinfecting liquid in said activation position. While the dispensing member in the non-activated standby position retains the stored cleaning or disinfecting liquid in the storage container, said dispensing organ in the activation position thereof releases the cleaning or disinfecting liquid such that the latter can now flow out of the storage container in the desired quantity and/or over the desired period.

The handling element can be configured as a lever that is pivotably mounted on the shaft. However, one preferred refinement according to the invention provides that the handling element is configured as a push or activation button which is guided in a displaceable manner in the interior of the tube of the shaft and in the non-activated standby position of said handling element projects beyond one of the end faces of the shaft. If this handling element is configured as a push or activation button which in the non-activated standby position projects beyond one of the end faces of the shaft, practically the entire shaft length is readily available for moving the cleaning device according to the invention across the floor, wall, and/or ceiling region to be cleaned.

One preferred refinement according to the invention provides that in the separation region between two adjacent and preferably releasably inter-connectable shaft portions, the rod portion that is provided in the shaft portion that faces the handling element at least during the activation movement of the connecting rod to the activation position impinges the rod portion of the connecting rod that is disposed in the shaft portion that faces away from the handling element with pressure in a de-couplable manner. In the case of such a refined embodiment, the adjacent and in particular releasably inter-connectable shaft portions can be interconnected without the shaft portions located in the interior of the tube still having to be interconnected in conditions in which said shaft portions are difficult to reach. Since the shaft portions impinge one another at least during the activation movement, an actuation movement that is exerted by way of a compressive force on the handling element can be readily transmitted from the shaft portion that faces the handling element to the shaft portion that faces away from the handling element.

In order for the push or activation button at the end face of the shaft to be able to be readily assembled in a simple manner, one embodiment according to the invention provides that the tubular shaft portion that guides therein the push or activation button in displaceable manner is formed from two tube segments that bear on one another by way of adjacent longitudinal sides.

The tube segments that bear on one another herein can be held together by connection tongues that are molded to the tube segments and are push-fittable into the interior of the tube of the adjacent shaft portion, and/or by at least one connection ring that encompasses the tube segments. The tube portion that therein guides the handling element is in this way readily assemblable from the two tube segments without further tools being necessary for this purpose.

In order for the handling element that is configured as a push or activation button at all times to be moved back to the non-activated standby position thereof, it is advantageous for at least one spring-elastic element to be provided as the restoring force. This spring-elastic element can also be produced from an elastomer, for example. However, an embodiment in which the spring-elastic element is formed by at least one compression spring is preferred.

In order for such a spring-elastic element to be able to exert a corresponding restoring force on the handling element that is configured as a push or activation button, it is advantageous for the at least one spring-elastic element to be disposed between a counter support that is preferably configured as an annular shoulder or as an annular flange and the adjacent end side of the push or activation button.

In order for the restoring spring or a similar spring-elastic element which exerts the restoring force to not also be able to urge the handling element out of the tube end of the tubular shaft, it is advantageous for the restoring movement of the push or activation button to the standby position to be delimited by a detent in the interior of the tube of the shaft portion that guides therein this handling element.

In order for the shaft portion that is formed from the tube segments and guides therein the handling element to be protected against inadvertently falling apart, it is advantageous for the shaft portion that guides therein the handling element, on the one hand, and the shaft portion that is adjacent to the latter, on the other hand, to be immovably interconnected in the longitudinal direction of the shaft.

In order for the shaft portions of the shaft to be able to be interconnected in a simple way, it is advantageous when, of the inter-connectable adjacent shaft portions, one shaft portion supports at least one flexible tongue on which at least one latching cam projects, and that the at least one flexible tongue in the push-fitting or inserting of the shaft portion that supports the flexible tongue into the interior of the tube of the adjacent shaft portion is movable by spring action from a compressed-spring sliding position to a holding position that in relation to the latter is unstressed, the latching cams in said holding position projecting into an assigned latching opening on the circumference of the tube of the adjacent shaft portion. This design embodiment of the inter-connectable adjacent shaft portions also facilitates a tool-less but nevertheless stable assembly of the shaft that is part of the cleaning device according to the invention.

In the case of the shaft portion that guides therein the handling element and is formed from the tube segments that bear on one another it can herein be advantageous for the tube segments in each case on the at least one connection tongue thereof to be connected to the at least one flexible tongue such that the flexible tongues in the push-fitting of the connection tongues here too move by spring action from a compressed-spring sliding position to a holding position that in relation to the latter is unstressed, the latching cams in said holding position projecting into an assigned latching opening on the circumference of the tube of the adjacent shaft portion.

If the adjacent shaft portions are to be non-releasably interconnected, the latching openings that are provided on the internal circumference of the tube of the adjacent shaft portion can also be configured as blind holes. However, in order for the interconnected adjacent shaft portions also to be able to be separated again from one another when required, it is advantageous for the latching openings to penetrate a circumferential wall of the tube of the adjacent shaft portion.

In order for the adjacent shaft portions that are interconnected in a readily releasable manner to be interconnected in a stable and stressable manner, it is advantageous for two flexible tongues which are interconnected in the manner of pliers to be provided. One preferred embodiment according to the invention provides herein that the latching cams that are preferably provided at the free tongue ends of the flexible tongues that are interconnected in the manner of pliers penetrate engagement openings which are disposed on the circumference of the tube of the shaft portion that supports the flexible tongues in the part-region of said shaft portion that is reduced in the cross section, and that the latching cams, with a cam portion that projects beyond the assigned engagement opening, in the holding position project into the associated latching opening of the adjacent shaft portion.

In order for at least one of the shaft portions to be able to be designed in a simple way so as to have a part-region that is reduced in the cross section, it is provided that at least one of the shaft portions has a shaft sleeve which by way of one of the shaft sleeve end regions thereof is insertable into a an insert opening of an adapter sleeve, said adapter sleeve at the end side thereof that faces away from the shaft sleeve having the part-region of the shaft portion that is reduced in the cross section. The shaft sleeve herein can also be produced from a metallic tube portion, for example, while the adapter sleeve by contrast can also be produced as an injection-molded part and in particular as a plastic injection-molded part.

In order for the shaft sleeve to now be connected to the adapter sleeve of the same shaft portion, and/or in order for the flexible tongues that are interconnected in the manner of pliers to be held in a simple way in the shaft sleeve, it is advantageous for the flexible tongues that are interconnected in the manner of pliers to support in each case at least one retaining pin, said retaining pins projecting into pin openings of the shaft portion. This design embodiment also facilitates the largely tool-less assembly of the cleaning device according to the invention.

The adapter sleeve is held in a simple way on the shaft sleeve of the shaft portion when the retaining pins penetrate the pin openings that are provided in the shaft sleeve of the shaft portion and by way of the free pin end of said retaining pins engage in retaining openings on the circumference of the sleeve of the adapter sleeve.

In order for the connecting rod that is formed from the rod portions to be able to be routed through the interior of the tube of the tubular shaft also in the region of these flexible tongues, it is advantageous for the flexible tongues that are interconnected in the manner of pliers, in the connection region of the plier-shaped of said flexible tongues, to have a rod opening, said rod opening being penetrated by a rod portion of the connecting rod.

There is furthermore also the object of being able to expel the cleaning or disinfecting liquid from the storage container in a manner that is simple as possible. In order for this object to be achieved, a further inventive feature according to the invention which can be implemented additionally or alternatively to the features described above on the cleaning device according to the invention, proposes that the storage container is designed as a pressurized container, that an air pump is integrated in the storage container that is designed as a pressurized container, a positive pressure in the interior of the container of the storage container being generatable for expelling the cleaning or disinfecting liquid that is stored in the storage container by said air pump, and that the air pump has a pump piston that is clisplaceably guided in a pump cylinder and by way of a piston rod is connected to a handling element that is activatable outside the storage container.

By activating the air pump that is integrated in the storage container that is designed as a pressurized container, air can thus be pumped into the interior of the container, said air pressurizing the cleaning or disinfecting liquid that is stored in the interior of the container in such a manner that at least a part-quantity of the stored cleaning or disinfecting liquid is expelled from the storage container when the dispensing member is released. Since the cleaning or disinfecting liquid is stored in the storage container at a positive pressure, it is also possible for the cleaning or disinfecting liquid to be expelled from the storage container when said storage container and conjointly there with the cleaning device according to the invention are not in vertically oriented position. Cleaning of wall and ceiling surfaces with the aid of the cleaning device according to the invention is also significantly facilitated on account thereof.

In order for the positive pressure that is formed in the storage container not to be able to readily be discharged again from the interior of the container of the storage container, it is advantageous for the air pump on the end region of the pump cylinder that faces away from the handling element to have an outlet valve.

One embodiment according to the invention that is particularly simple and associated with low complexity in terms of production herein provides that the outlet valve is configured as a diaphragm valve.

In order for the positive pressure that is maintained in the storage container to be able to be discharged again if required without the entire quantity of the cleaning or disinfecting liquid herein having to be expelled by way of the outlet line, it is advantageous for the storage container to have a pressure relief valve which is manually activatable for reducing the pressure in the interior of the container of the storage container.

The storage container can be serviced and cleaned in a simple way when the preferably cylindrical storage container has a container lid, and when the pump cylinder of the air pump and/or the relief valve are/is provided on the container lid.

One particularly advantageous and compact embodiment of the invention provides that a container support is provided on the shaft of the cleaning device, that the storage container is held so as to be releasably fastenable to the container support, that the outlet line has a line portion that is routed through the container support, and that the interior of the container of the storage container and the line portion of the storage container that is routed through the container support are releasably inter-couplable by way of a liquid-tight coupling.

One preferred embodiment according to the invention herein provides that the liquid-tight coupling has a port-shaped or pin-shaped coupling part, provided on the storage container or on the container support, having a first, preferably central, liquid opening, and that the port-shaped or pin-shaped coupling part is insertable into a coupling counterpart having a second, preferably corresponding, liquid opening. The cleaning or disinfecting liquid can thus be routed to the outside by way of the in particular mutually corresponding liquid openings in the coupling part and in the coupling counterpart through the outlet line of the cleaning device according to the invention.

It is possible for a pliable line portion which can be closed by pressurization and opened by depressurization to be provided in the outlet line. However, one preferred embodiment according to the invention which facilitates a precise delivery of the cleaning or disinfecting liquid in terms of quantity provides that the dispensing member is configured as an extraction valve.

The handling of the cleaning device according to the invention is significantly simplified, and fatigue of the user due to repeated activation of the handling element is effectively counteracted, when the dispensing member is disposed on the container support at a spacing from the shaft, and when a two-armed pivot lever is pivotably mounted on the container support, said pivot lever by way of one arm end thereof in terms of drive being connected to the connecting rod and by way of the other arm end thereof engaging on the dispensing member. In the case of this preferred embodiment, the leverage of the two-armed pivot lever is utilized for significantly reducing the force that is required for activating the dispensing member.

One preferred embodiment according to the invention which in the closed position of the dispensing member effectively prevents any undesirable leakage of the storage container provides that the dispensing member that is configured as an extraction valve has a valve body that is preferably designed as a valve ball, said valve body, counter to a restoring force, in particular counter to the restoring force of at least one spring-elastic restoring element, being movable from a closed position to the open position.

In order for also a storage container that is still filled with cleaning or disinfecting liquid to be able to be readily released and removed from the container support without having to risk any leakage, it is advantageous for the valve body that is impinged by the restoring element to be provided in the liquids opening of the coupling part that is disposed on the storage container. Since this valve body is impinged by the restoring element and is pushed against a valve seat in the liquid opening of the coupling part that is disposed on the storage container, there is no risk of any inadvertent outflow of the cleaning or disinfecting liquid from the storage container.

In order for the extraction valve when required to be moved to the open position thereof, it is advantageous for the extraction valve to have a valve body lifter by which the valve body is movable from the closed position thereof to the open position.

In order for the activation or compressive force that is exerted on the handling element to be able to be transferred and transmitted in a simple and forceful way to the dispensing member, it is advantageous for an actuation movement of the connecting rod by the pivot lever to be convertible to an opening movement of the valve body lifter.

One preferred embodiment which significantly facilitates the expulsion of the cleaning and/or disinfecting liquid herein provides that the valve body lifter is configured in a sleeve-shaped manner, and that the one sleeve end of the valve body lifter projects into the liquids opening of the storage container, while the other sleeve end of the valve body lifter opens into the line portion that is routed in the container support.

A delivery of the cleaning or disinfecting liquid is significantly facilitated when the cleaning device at the shaft end that faces away from the handling element has a distribution face for spreading the cleaning or disinfecting liquid. Water can also serve as the cleaning liquid herein, in particular when a further chemical cleaning or disinfecting agent is to be applied to the surface to be cleaned independently of the cleaning or disinfecting liquid that is stored in the storage container.

The simple handling of the cleaning device according to the invention is significantly facilitated even more when the distribution face and the shaft end are interconnected in an articulated manner and preferably by way of an, in particular, universal joint.

BRIEF DESCRIPTION OF THE DRAWINGS

Refinements according to the invention are derived from the description hereunder of a preferred exemplary embodiment in conjunction with the claims and the drawings.

The invention will be described in more detail hereunder with reference to a preferred exemplary embodiment.

In the figures:

FIG. 1 shows a cleaning device that is assembled from a plurality of components and is shown here in a perspective view, said cleaning device having a shaft which is configured in multiple parts and has at least two releasably inter-connectable shaft portions;

FIG. 2 shows the cleaning device from FIG. 1 having the shaft portions thereof released from one another, wherein a storage container which is provided for storing a cleaning or disinfecting liquid is connectable to the shaft of the cleaning device;

FIG. 3 shows the cleaning device from FIGS. 1 and 2 in a longitudinal section through the components thereof;

FIG. 4 shows a part-region of the shaft that is provided on the free shaft end of the cleaning device that faces away from the surface to be cleaned, said part-region at the end face thereof having a handling element that is activatable as a push or activation button;

FIG. 5 shows the shaft portion shown in FIG. 4 in an exploded detailed illustration of the components of said shaft portion FIG. 6 shows the shaft portion from FIGS. 4 and 5 in a longitudinal section;

FIG. 7 shows the storage container of the cleaning device shown in FIGS. 1 to 6 in a perspective illustration;

FIG. 8 shows the storage container from FIG. 7 in a side view;

FIG. 9 shows the storage container from FIGS. 7 and 8 in a longitudinal section;

FIG. 10 shows the storage container from FIGS. 7 to 9 in a perspective side view;

FIG. 11 shows the storage container from FIGS. 7 to 10 in an exploded perspective illustration of the components of said storage container; and FIG. 12 shows the storage container in a longitudinal section, said storage container as opposed to FIG. 9 being completed with a lid.

DETAILED DESCRIPTION OF THE PREFERRED EMBODIMENTS

Figure 2:
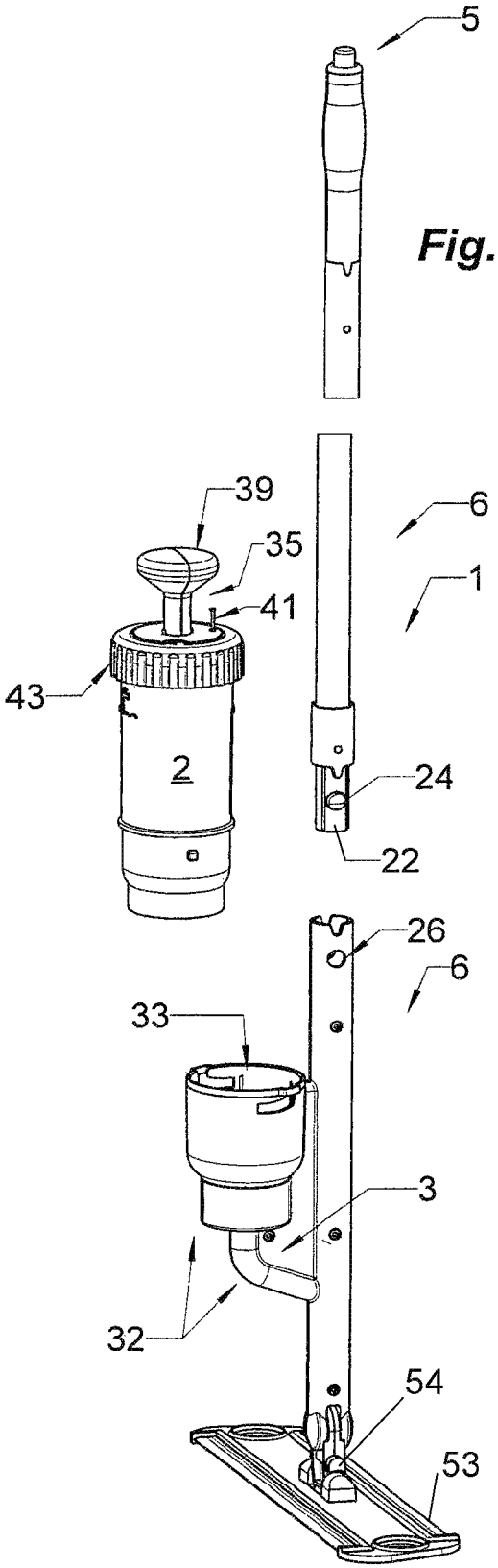

A cleaning device 1 which is specified for spreading a cleaning or disinfecting liquid is illustrated in FIGS. 1 to 12. The cleaning device 1 has a storage container 2 in which the cleaning or disinfecting liquid is stored. This storage container 2 is connected to an outlet line 3, a dispensing member 4 being interdisposed in said outlet line 3. The dispensing member 4 is manually activatable by way of a handling element 5 which is movably guided on a tubular shaft 6. The handling element 5 by way of a connecting rod 7 that is provided in the interior of the tube of the shaft 6 in terms of drive is connected to the dispensing member 4. The shaft 6 of the cleaning device 1 herein has at least two interconnectable tubular shaft portions 8, 9, and 10, in each case one assigned rod portion 11, 12 of the connecting rod 7 being provided in the interior of the tubes of said shaft portions 8, 9, and 10. Since the shaft 6 of the cleaning device 1 has at least two tubular shaft portions 8, 9, 10 which prior to transportation of the cleaning device 1 can also be packed separately from one another, and since said shaft portions 8, 9, 10 as compared to the shaft 6 that is assembled therefrom have only a shortened length, the transportation of the cleaning device 1 shown here is possible in a comparatively simple and space-saving manner.

It becomes evident from a comparison of FIGS. 1 to 6 that of the at least two shaft portions, at least two adjacent shaft portions 9, 10 are inter-connectable in a releasable and preferably releasably latchable manner. Since the shaft portions 9, 10 are inter-connectable in a releasably latchable manner, the shaft 6 of the cleaning device 1 can be taken apart in a simple way without tools when the cleaning device is to be transported in a space-saving manner from one application site to another.

Of the inter-connectable adjacent shaft portions 8, 9, 10, in each case the shaft portion 8 that supports the handling element 5, or the shaft portion 9 that faces the handling element 5 and has an end face region that is reduced in the cross section, is insertable or push-fittable into the interior of the tube of the adjacent shaft portion 9 or 10, respectively. In order for the shaft 6 to be able to be readily gripped practically across the entire length thereof, the handling element 5 here is configured as a push or activation button which is displaceably guided in the interior of the tube of the shaft 6 and in the non-activated standby position of said handling element 5, shown in FIGS. 1 to 6, projects beyond one of the end faces of the shaft 6. The handling element 5 herein, counter to a restoring force, is movable from this non-activated standby position to an activation position, in which activation position the dispensing member 4 dispenses the cleaning or disinfecting liquid.

In the separation region between the adjacent and releasably inter-connectable shaft portions 9, 10, the rod portion 11 of the connecting rod 7 that is provided in the shaft portion 9 that faces the handling element 5 is capable of impinging in a de-couplable manner the rod portion 12 that is disposed in the shaft portion 10 that faces away from the handling element 5 with pressure at least during the activation movement of the connecting rod 7 to the standby position. The shaft portions 9, 10 can in this way be releasably interconnected in a simple manner without the rod portions 11, 12 that are located in these shaft portions 9, 10 also having to be additionally intercoupled.

Figure 5:
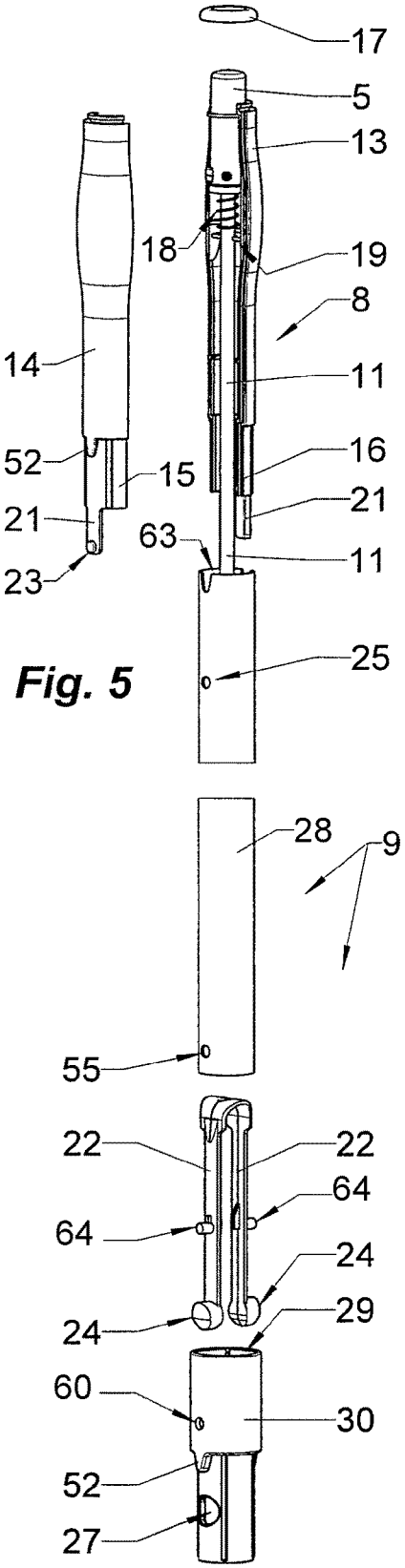
Figure 4:
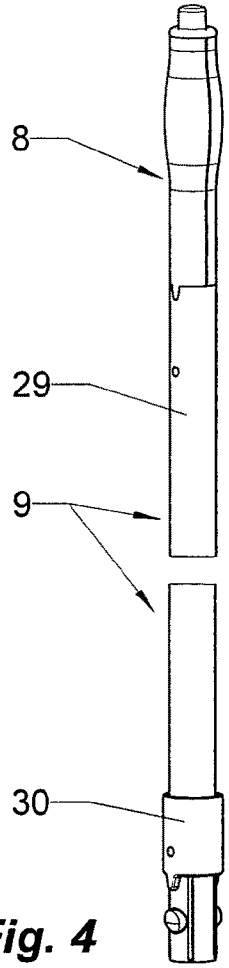
Figure 7:
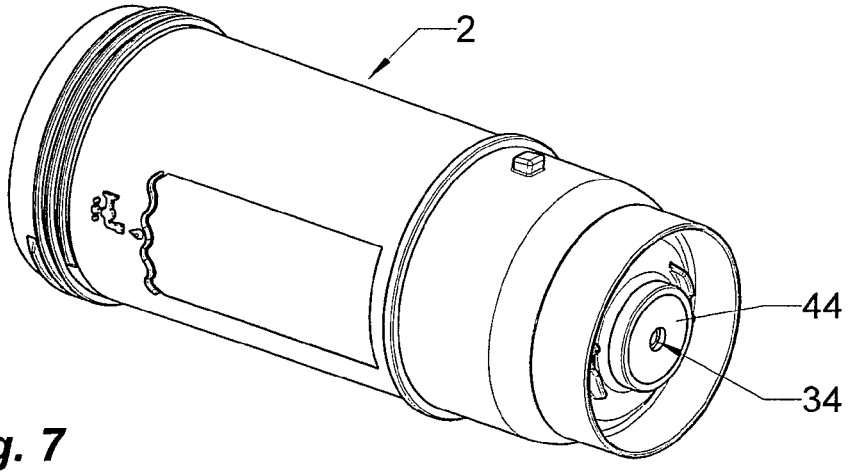

It can be seen in FIG. 5 that the tubular shaft portion 8 that therein displaceably guides the push or activation button is formed from two tube segments 13, 14 that by way of adjacent longitudinal sides bear on one another. In order for the shaft portion 8 to be able to be likewise assembled without tools from the tube segments 13, 14, the tube segments 13, 14 that bear on one another are held together by connection tongues 15, 16 that are molded to the tube segments 13, 14 and are push-fittable into the interior of the tube of the adjacent shaft portion and by at least one connection ring 17 that encompasses the tube segments 13, 14. An additional screw connection of the tube segments 13, 14 is thus not required.

At least one spring-elastic element is provided as the restoring force that is assigned to the handling element 5. This spring-elastic element here is formed by a compression spring 18. The compression spring 18 is disposed between a counter support, here configured as an annular flange 19, and the adjacent end side of the push or activation button that serves as the handling element 5. The restoring movement of the push or activation button that serves as the handling element 5 to the standby position here is limited by a detent 20 in the interior of the tube of the shaft portion 8 that receives therein this handling element 5.

It becomes evident from FIG. 2 and from a comparison of FIGS. 1 to 6 that the shaft portion 8 that therein guides the handling element 5, and the shaft portion 9 that is adjacent thereto, are immovably interconnected in the longitudinal direction of the shaft. By contrast, a releasable latching connection which if required can at any time be readily released without tools is provided between the shaft portion 9 and the shaft portion 10 that faces the cleaning surface.

Of the inter-connectable adjacent shaft portions 8, 9, or 9, 10, respectively, one shaft portion supports at least one flexible tongue 21 or 22, respectively, at least one latching cam 23 or 24, respectively, projecting on the latter. This at least one flexible tongue 21; 22 during the push fitting or inserting of the shaft portion 8 that supports the flexible tongue 21 or 22, respectively, into the interior of the tube of the adjacent shaft portion 9 or 10, respectively, is movable by spring action from a compressed-spring sliding position to a holding position that in relation to the latter is unstressed, the latching cams 23, 24 in said holding position projecting into an assigned latching opening 25 or 26, respectively, on the circumference of the tube of the adjacent shaft portion. In the case of the shaft portion 8 that therein guides the handling element 5 the tube segments 13, 14 are connected by way of the connection tongues 15, 16 in each case to a flexible tongue 21.

In order to be able to release the shaft portions 8 and 9, or 9 and 10, respectively, more or less easily from one another, the more or less large latching openings 25, 26 penetrate a circumferential wall of the tube of the adjacent shaft portion 9 or 10, respectively.

It can be particularly readily seen in FIG. 5 that the shaft portions 9, 10 are held together by way of two flexible tongues 22 which are interconnected in the manner of pliers. The latching cams 24 that are preferably provided on the free tongue ends of the flexible tongues 22 that are interconnected in the way of pliers herein penetrate engagement openings 27 on the circumference of the tube of the shaft portion that supports the flexible tongues 22, wherein the engagement openings 27 are disposed in the part-region of this shaft portion that is reduced in the cross section. The latching cams 24 in the holding position by way of a cam portion that projects beyond the assigned engagement opening 24 project into the assigned latching opening 26 of the adjacent shaft portion 10. The shaft portion 9 is formed from a shaft sleeve 28 which by way of the one shaft sleeve end region thereof can be inserted into an insert opening 29 of an adapter sleeve 30. This adapter sleeve 30 which can be produced as an injection-molded part and in particular as a plastic injection-molded part, at the end face thereof that faces away from the shaft sleeve 28 has the part-region of the shaft portion 9 that is reduced in the cross-section. The flexible tongues 22 that are interconnected in the manner of pliers, in the connection region of the plier shape thereof, have a rod opening 31 which is penetrated by the rod portion 11 that is assigned collectively to the shaft portions 8, 9. Retaining pins 64 are located on the tongues 22 and are received in corresponding pin openings 60 in the adapter sleeve 30.

Figure 1:
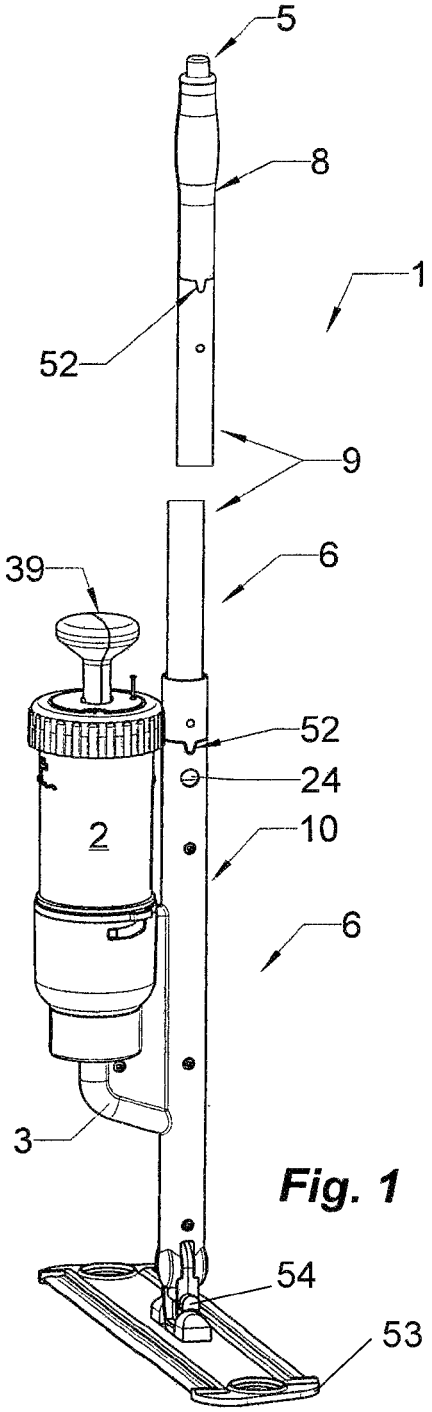

It can be seen from FIGS. 1 and 2 that the storage container is held on the shaft 6 of the cleaning device 1 and in particular on the shaft portion 10 thereof. To this end, a container support 32 which has a container receptacle 33 into which the storage container 2 is releasably insertable is provided on the shaft 6 and in particular on the shaft portion 10 that faces the cleaning surface. The storage container 2 that is insertable upside down into the container receptacle 32 and thus with the liquids opening 34 of said storage container 2 facing the cleaning surface, is releasably held in the container receptacle 33 by way of a screw connection or as presently by way of a bayonet fastening. An air pump 35, by which a positive pressure for expelling the cleaning or disinfecting liquid that is stored in the storage container 2 is generatable in the interior of the container of the storage container 2, is integrated in the storage container 2 that is designed as a pressurized container. This air pump 35 has a pump piston 37 which is displaceably guided in a pump cylinder 36 and by way of a piston rod 38 is connected to a handling element 39 that is activatable outside the storage container 2. The air pump 35 that is integrated in the storage container 2 at the end region of the pump cylinder 36 that faces away from the handling element 39 has an outlet valve 40 which here is configured as a diaphragm stop valve. A pressure relief valve 41 which for reducing the pressure of a potential positive pressure that has built up in the interior of the container is manually activatable is also provided on the storage container 2. The presently cylindrical storage container 2 has a container lid 43 which is tightly screw-fittable onto the pot-shaped storage container 2 and presently onto the end face region of said storage container 2 that faces away from the liquids opening 34. The pump cylinder 36 of the air pump 35 that projects into the interior of the container, and the relief valve 41, are provided on the container lid 43.

Figure 3:
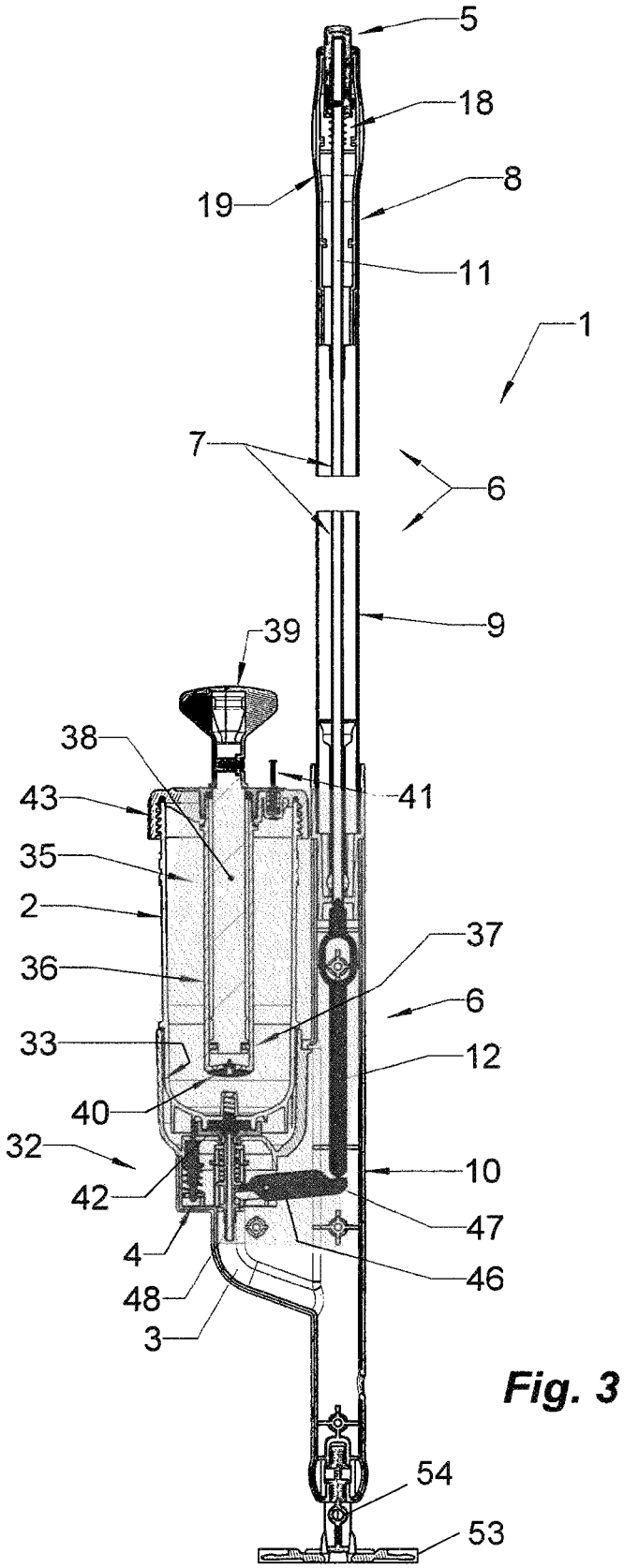
Figure 6:
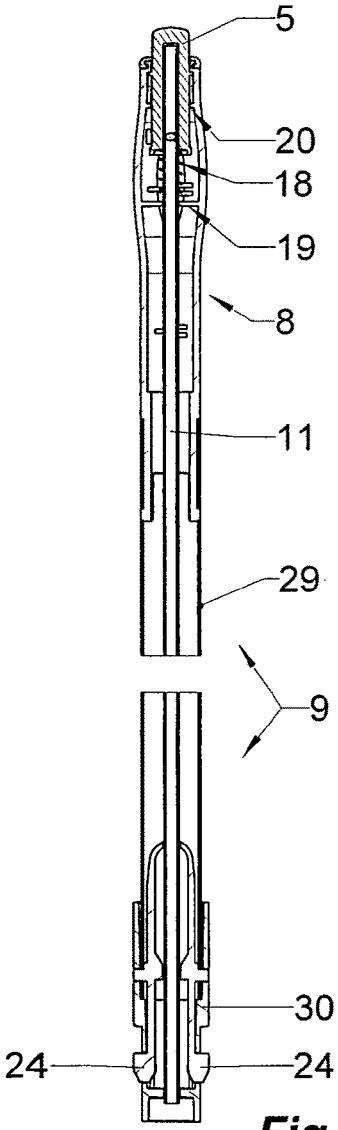

It can be particularly readily seen in FIG. 3 that the outlet line 3 has a line portion that is routed through the container support 32, and that the storage container 2 by way of a liquid-tight coupling 42 is releasably couplable to the line portion that is routed in the container support 32. This liquid-tight coupling 42 has a port-shaped or pin-shaped coupling part 44 having one of the liquid openings 34, wherein the coupling part 44 is insertable into a coupling counterpart 45 having a second, preferably corresponding, liquid opening. This second corresponding liquid opening is disposed on the base of the container receptacle 33 and opens into the line portion of the outlet line 3 that is routed through the container support 32.

Figure 9:
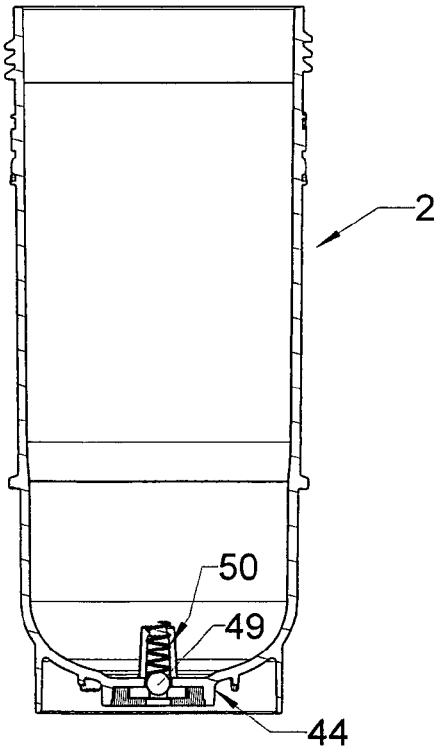
Figure 8:
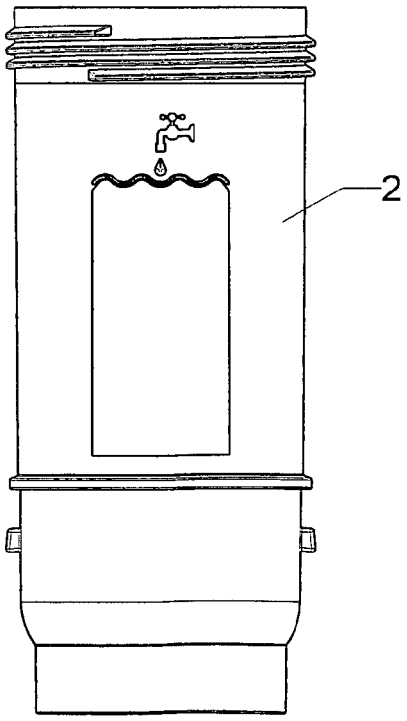
Figure 11:
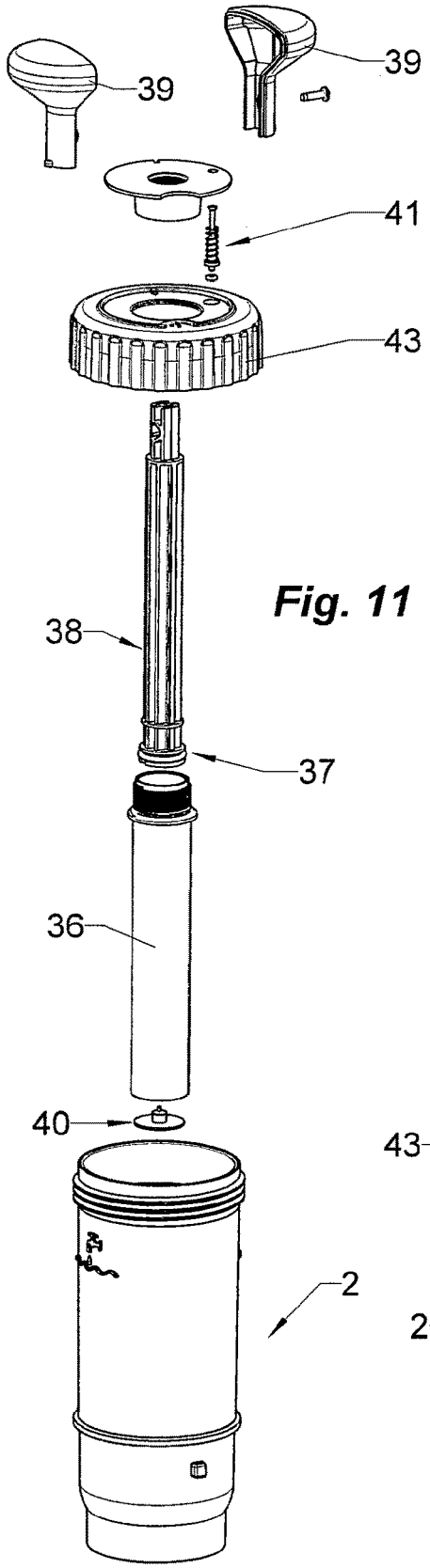
Figure 12:
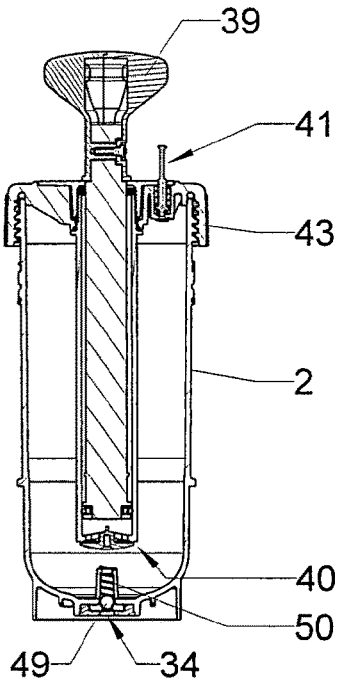
Figure 10:
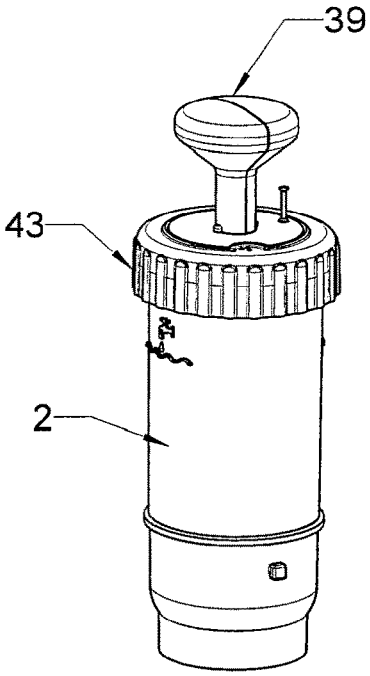

When viewed together, it becomes evident from FIGS. 3, 9, and 12 that the dispensing member 4 that here is configured as an extraction valve is disposed on the container support 32 at a spacing from the shaft 6. A two-armed pivot lever 46 herein is pivotably mounted on the container support 32, said pivot lever 46 by way of one arm end 47 thereof in terms of drive being connected to the connecting rod 7 and by way of the other arm end 48 thereof engaging on the dispensing member 4. The compression force that is to be exerted on the handling element 5 can advantageously be significantly reduced by the leverage that is amplified by the pivot lever 46.

The dispensing member 4 that here is configured as an extraction valve has a valve body 49 that is preferably designed as a valve ball, said valve body 49 being movable from a closed position to an open position counter to the restoring force of at least one spring-elastic restoring element 50 that is preferably configured as a restoring spring. The valve body 49 that is impinged by the restoring element 50 here is provided in the liquid opening 34 of the storage container 2 such that this storage container 2 can also be removed from the container receptacle 33 in the filled state without the risk of any leakage of the stored cleaning or disinfecting liquid, specifically because the extraction valve closes when the storage container 2 is removed from the container receptacle 33 and the valve body 49 to this end with the aid of the restoring element 15 is tightly pressed against a valve seat. The dispensing member 4 that is configured as an extraction valve also has a valve body lifter 51 by which the valve body 49 is movable from the closed position thereof to the open position. An actuation movement of the connecting rod 7 can be converted to an opening movement of the valve body lifter 51 by the pivot lever 46. This valve body lifter 51 here is configured in the shape of a sleeve, wherein the one sleeve end of the valve body lifter projects into the liquid opening 34 of the storage container 2, while the other sleeve end of the valve body lifter 51 opens into the line portion of the outlet line 3 that is routed in the container support 32. The desired part-quantity of the cleaning or disinfecting liquid that is located in the storage container 2 can thus exit to the outside by way of the line portion of the outlet line 3 that is routed in the container support 32 when the dispensing member is activated by means of the handling element 5. It becomes evident from FIG. 3 that the hose line that is routed in the container support and opens out in the interior of the tube of the line portion 10 can be routed to the outside, said hose line being routed out of the shaft portion 10 by way of a conduit opening 52.

A distribution face 53 for spreading the cleaning or disinfecting liquid is provided on the shaft end of the shaft 6 that faces away from the handling element 5. The distribution face 53 and the shaft end of the shaft 6 are interconnected in an articulated manner, preferably by way of a joint 54 which here is designed as a universal joint. In order for the cleaning or disinfecting liquid that is applied to the surface to be cleaned to be delivered in a better manner, a cleaning cloth (not shown in more detail here) can be held on the distribution face 53. The cleaning cloth that is held on the distribution face 53, at least by way of the longitudinal sides of said cleaning cloth, is releasably and or replaceably held on the distribution face 53, preferably by way of a respective hook-and-pile connection It can be readily seen in FIGS. 1, 2, 4, and 5 that the shaft portions 8, 9, or 9, 10, respectively, by the use of an anti-rotation device are secured against relative mutual rotation. To this end, at least one anti-rotation protrusion 52 is provided on one of the adjacent shaft portions 8, 9, or 9, 10, respectively, that is received in an anti-rotation clearance 63 that are assigned to one another in pairs, said anti-rotation protrusion 52 projecting on the external circumference of the tube of said shaft portion 8 or 9, respectively, and engaging in an anti-rotation clearance 63 that is assigned on the external circumference of the tube of the adjacent shaft portion 9 or 10, respectively.

LIST OF REFERENCE SIGNS

1 Cleaning device
2 Storage container
3 Outlet line
4 Dispensing member
5 Handling element
6 Shaft
7 Connecting rod
8 First shaft portion (facing the handling element 5)
9 Second shaft portion
10 (Third) shaft portion facing the surface to be cleaned
11 First rod portion (connected to the handling element 5) of the connecting rod 7
12 Second rod portion of the connecting rod 7
13 Tube segment (of the first shaft portion 8)
14 Tube segment (of the first shaft portion 8)
15 Connection tongue
16 Connection tongue
17 Connection ring
18 Compression spring
19 Annular flange
20 Detent
21 Flexible tongues (on the first shaft portion 8)
22 Flexible tongues (on the second shaft portion 9)
23 Latching cams (on the flexible tongues 21)
24 Latching cams (on the flexible tongues 22)
25 Latching opening
26 Latching opening
27 Engagement opening
28 Shaft sleeve
29 Insert opening
30 Adapter sleeve
31 Shaft opening
32 Container support
33 Container receptacle
34 Liquid opening
35 Air pump
36 Pump cylinder
37 Pump piston
38 Piston rod
39 Handling element
40 Outlet valve
41 Pressure relief valve
42 Liquid-tight coupling
43 Container lid
44 Coupling part
45 Coupling counter-part
46 Pivot lever

47 First arm end (of the pivot lever 46)
48 Second arm end (of the pivot lever 46)
49 Valve body
50 Restoring element
51 Valve body lifter
52 Anti-rotation protrusion
53 Distribution Face
54 Universal Joint
55 Pin openings
56 Retaining openings
60 Pin Opening
63 Anti-rotation clearance
64 Retaining Pin

The invention claimed is:

1. A cleaning device (1) for spreading a cleaning or disinfecting liquid, comprising a storage container (2) for storing the cleaning or disinfecting liquid, a dispensing member (4) which (4) is interdisposed in an outlet line (3) connected to the storage container (2), a handling element (5) that activates the dispensing member (4), a tubular shaft (6) on which the handing element (5) is guided or held in a movable manner, the handing element including a push or activation button that extends from one end of the tubular shaft and is axially displaceable and guided in an interior of the tubular shaft, a connecting rod (7) in an interior of a tube of the shaft (6), the connecting rod (7) connecting the handing element (5) to the dispensing member (4) for actuation thereof, the connecting rod being formed of two rod portions (11, 12), the shaft (6) of the cleaning device (1) has at least two inter-connectable tubular shaft portions (8, 9; 9, 10), and one said rod portion (11, 12) of the connecting rod (7) is provided in an interior of a respective one of each said tubular shaft portion (8, 9; 9, 10), wherein, of the at least two tubular shaft portions (8, 9, 10) at least two adjacent ones of the tubular shaft portions (8, 9; 9, 10) are inter-connectable in a releasable manner, the handling element (5) is movable counter to a restoring force from a non-activated standby position to an activation position of said handling element (5), and the dispensing member (4) is adapted to dispense the cleaning or disinfecting liquid in said activation position, a separation region between two adjacent releasably inter-connectable tubular shaft portions (9, 10), the rod portion (11) provided in the shaft portion (9) and the rod portion (12) of the connecting rod (7) are de-couplable, and the rod portion (11) that is provided in the shaft portion (9) that faces the handing element (5) at least during an activation movement of the connecting rod (7) into the activation position impinges the rod portion (12) of the connecting rod (7) that is disposed in the shaft portion (10) that faces away from the handling element (5) with pressure, the tubular shaft portion (8) that guides the push or activation button therein in a displaceable manner is formed from two tube segments (13, 14) that bear on one another by way of adjacent longitudinal sides thereof, and the tube segments (13, 14) that bear on one another are held together by connection tongues (15, 16) that are molded to the tube segments (13, 14) and are push-fittable into the interior of the adjacent tubular shaft portion (9).

2. The cleaning device as claimed in claim 1, wherein of the inter-connectable adjacent tubular shaft portions (8, 9; 9, 10), one said shaft portion (8) that supports the handling element or the shaft portion (9) that faces the handling element (5) is insertable or plug-fittable into the interior of the adjacent tubular shaft portion (9; 10).

3. The cleaning device as claimed in claim 1, further comprising at least one spring-elastic element that provides a restoring force.

4. The cleaning device as claimed in claim 3, wherein the at least one spring-elastic element is disposed between a counter support configured as an annular shoulder or as an annular flange (19) in the tubular shaft portion (8) that guides the push or activation button and an adjacent end side of the push or activation button.

5. The cleaning device as claimed in claim 4, wherein a restoring movement of the push or activation button to the standby position is delimited by a detent (20) in the interior of the tubular shaft portion (8) that guides said push or activation button therein.

6. The cleaning device as claimed in claim 1, wherein the tubular shaft portion (8) that supports the handling element, and the tubular shaft portion (8) that is adjacent thereto, are immovably interconnected in a longitudinal direction of the shaft.

7. A cleaning device (1) for spreading a cleaning or disinfecting liquid, comprising a storage container (2) for storing the cleaning or disinfecting liquid, a dispensing member (4) which (4) is interdisposed in an outlet line (3) connected to the storage container (2), a handling element (5) that activates the dispensing member (4), a tubular shaft (6) on which the handling element (5) is guided or held in a movable manner, a connecting rod (7) in an interior of the tube of the shaft (6), the connecting rod (7) connecting the handling element (5) to the dispensing member (4) for actuation thereof, the connecting rod being formed of two rod portions (11, 12) the shaft (6) of the cleaning device (1) has at least two inter-connectable tubular shaft portions (8, 9; 9, 10), and one said rod portion (11, 12) of the connecting rod (7) is provided in an interior of a respective one of each said tubular shaft portion (8, 9; 9, 10), the inter-connectable adjacent tubular shaft portions (8, 9; 9, 10), one said tubular shaft portion (8; 9) supports at least one flexible tongue (21; 22) on which at least one latching cam (23; 24) projects, and the at least one flexible tongue (21; 22) during push-fitting or inserting of the tubular shaft portion (8, 9) that supports the flexible tongue (21; 22) into the interior of the adjacent tubular shaft portion (9; 10) is movable by spring action from a compressed-spring sliding position to a holding position that in relation to the latter is unstressed, the latching cams (23; 24) in said holding position projecting into an assigned latching opening (25; 26) on a circumference of the adjacent tubular shaft portion (9; 10).

8. The cleaning device as claimed in claim 7, further comprising a push or activation button which is displaceably guided in an interior of the tube of the shaft, and the tubular shaft portion (8) that guides therein the push or activation button in a displaceable manner is formed from two tube segments (13, 14) that bear on one another by way of adjacent longitudinal sides thereof, the tube segments (13, 14) that bear on one another are held together by connection tongues (15, 16) that are molded to the tube segments (13, 14) and are push-fittable into the interior of the adjacent tubular shaft portion (9), or by at least one connection ring (17) that encompasses the tube segments (13, 14), and the tube segments (13, 14) in each case on the at least one connection tongue (15, 16) thereof are connected to the at least one flexible tongue (21).

9. The cleaning device as claimed in claim 8, wherein the latching openings (25, 26) penetrate a circumferential wall of the tube of the adjacent tubular shaft portion (9, 10).

10. The cleaning device as claimed in claim 9, wherein that at least one flexible tongue comprises two of the flexible tongues (22) which are interconnected at one end in a pliers arrangement.

11. The cleaning device as claimed in claim 10, wherein the latching cams (24) engage in engagement openings (27) disposed on the circumference of the tubular shaft portion (9) that supports the flexible tongues (22) in a part-region of said tubular shaft portion (9) that is reduced in cross section, and the latching cams (24), in a cam portion that projects beyond the assigned engagement opening (27), in the holding position project into the associated latching opening (26) of the adjacent tubular shaft portion (10).

12. The cleaning device as claimed in claim 10, wherein at least one of the tubular shaft portions (9) has a shaft sleeve (28) which by way of one of the shaft sleeve end regions thereof is insertable into an insert opening (29) of an adapter sleeve (30), said adapter sleeve (30) at an end side thereof that faces away from the shaft sleeve (28) includes a part-region of the shaft portion that has a reduced cross section.

13. The cleaning device as claimed in claim 12, wherein the flexible tongues (22) support in each case at least one retaining pin (54), said at least one retaining pin (54) projecting into a respective at least one pin opening (55) of the shaft portion (9).

14. The cleaning device as claimed in claim 13, wherein the at least one retaining pin (54) penetrates the respective at least one pin opening (55) provided in the shaft sleeve (28) of the shaft portion (9) and by way of a free pin end of said respective at least one retaining pin (54) engages in a corresponding retaining opening (56) on a circumference of the sleeve of the adapter sleeve (30).

15. The cleaning device as claimed in claim 14, wherein the flexible tongues (22) include a rod opening (31) in a connection region thereof, said rod opening (31) being penetrated by one of the rod portions (11) of the connecting rod (7).

16. A cleaning device (1) for spreading a cleaning or disinfecting liquid, comprising a storage container (2) for storing the cleaning or disinfecting liquid, a dispensing member (4) which (4) is interdisposed in an outlet line (3) connected to the storage container (2), a handling element (5) that activates the dispensing member (4), a tubular shaft (6) on which the handling element (5) is guided or held in a movable manner, a connecting rod (7) in an interior of the tube of the shaft (6), the connecting rod (7) connecting the handling element (5) to the dispensing member (4) for actuation thereof, the connecting rod being formed of two rod portions (11, 12) the shaft (6) of the cleaning device (1) has at least two inter-connectable tubular shaft portions (8, 9; 9, 10), and one said rod portion (11, 12) of the connecting rod (7) is provided in an interior of a respective one of each said tubular shaft portion (8, 9; 9, 10), the storage container (2) is a pressurized container, and the cleaning device further comprises an air pump (35) integrated in the storage container (2) that generates a positive pressure in an interior of the storage container (2) that is adapted to expell the cleaning or disinfecting liquid that is stored in the storage container (2), and the air pump (35) has a pump piston (37) that is displaceably guided in a pump cylinder (36) and by way of a piston rod (38) is connected to a handling element (39) that is activatable outside the storage container (2).

17. The cleaning device as claimed in claim 16, further comprising an outlet valve (40) on the air pump (35) at an end region of the pump cylinder (36) that faces away from the handling element (39).

18. The cleaning device as claimed in claim 17, wherein the outlet valve (40) is configured as a diaphragm valve.

19. The cleaning device as claimed in claim 16, further comprising a pressure relief valve (41) on the storage container (2), the pressure relief valve (41) is manually activatable for reducing a pressure in the interior of the storage container (2).

20. The cleaning device as claimed in claim 16, wherein the storage container has a container lid (43), and at least one of the pump cylinder (36) of the air pump (35) or the relief valve (41) is provided on the container lid (43).

21. The cleaning device as claimed in claim 16, further comprising a container support (32) on the shaft (6) of the cleaning device (1), the storage container (2) is held releasably fastenable to the container support (32), the outlet line (3) has a line portion that is routed through the container support (32), and the interior of the storage container (2) and the line portion that is routed through the container support (32) are releasably intercouplable by a liquid-tight coupling (42).

22. The cleaning device as claimed in claim 21, wherein the liquid-tight coupling (42) has a port-shaped or pin-shaped coupling part (44), provided on the storage container (2) or on the container support (32), having a first liquid opening (34), and the port-shaped or pin-shaped coupling part (44) is insertable into a coupling counterpart (45) having a second liquid opening (34).

23. The cleaning device as claimed in claim 22, wherein the dispensing member (4) is configured as an extraction valve.

24. The cleaning device as claimed in claim 23, wherein the dispensing member (4) is disposed on the container support (32) at a spacing from the shaft (6), and the cleaning device further comprises a two-armed pivot lever (46) pivotably mounted on the container support (32), said pivot lever (46) by one arm end (47) thereof is connected to the connecting rod (7) and by another arm end (48) thereof engaging on the dispensing member (4).

25. The cleaning device as claimed in claim 24, wherein the dispensing member (4) that is configured as an extraction valve has a valve body (49) that is movable counter to a restoring force from a closed position to an open position.

26. The cleaning device as claimed in claim 25, further comprising a spring-elastic restoring element (50), and the valve body (49) that is impinged by the spring-elastic restoring element (50) is provided in the liquid opening (34) of the coupling part (44) that is disposed on the storage container (2).

27. The cleaning device as claimed in claim 26, wherein the extraction valve has a valve body lifter (51) by which the valve body (49) is movable from the closed position thereof to the open position.

28. The cleaning device as claimed in claim 27, wherein an actuation movement of the connecting rod (7) by the pivot lever (46) is convertible to an opening movement of the valve body lifter (51).

29. The cleaning device as claimed in claim 28, wherein the valve body lifter (51) has a sleeve shape, and one sleeve end of the valve body lifter (51) projects into the liquid opening (34) of the storage container (2), while another sleeve end of the valve body lifter (51) opens into a line portion that is routed in the container support (32).

30. The cleaning device as claimed in claim 1, wherein the cleaning device (1) at a shaft end that faces away from the handling element (5) has a distribution face (53) for spreading the cleaning or disinfecting liquid.

31. The cleaning device as claimed in claim 30, wherein the distribution face (53) and the shaft end are interconnected in an articulated manner by an universal joint (54).

* * * * *